299-13 SR
12/16/80 XR 4,239,284

United States Patent [19]
Ridley et al.
[11] 4,239,284
[45] Dec. 16, 1980

[54] SITU RETORT WITH HIGH GRADE FRAGMENTED OIL SHALE ZONE ADJACENT THE LOWER BOUNDARY

[75] Inventors: Richard D. Ridley; Robert J. Fernandes, both of Bakersfield, Calif.

[73] Assignee: Occidental Oil Shale, Inc., Grand Junction, Colo.

[21] Appl. No.: 17,432

[22] Filed: Mar. 5, 1979

[51] Int. Cl.[3] ..... E21C 41/10
[52] U.S. Cl. ..... 299/2; 299/13
[58] Field of Search ..... 299/2, 13, 19

[56] References Cited

U.S. PATENT DOCUMENTS

| | | | |
|---|---|---|---|
| 1,919,636 | 3/1930 | Karrick | 299/2 |
| 3,349,848 | 10/1967 | Burgh | 299/2 X |
| 3,460,867 | 8/1969 | Cameron et al. | 299/2 |
| 3,917,346 | 11/1975 | Janssen | 299/19 X |
| 3,917,347 | 11/1975 | Janssen et al. | 299/19 X |
| 4,025,115 | 4/1975 | French et al. | 299/13 X |

*Primary Examiner*—Ernest R. Purser
*Attorney, Agent, or Firm*—Christie, Parker & Hale

[57] ABSTRACT

An in situ oil shale retort is formed in a subterranean formation containing oil shale. Such an in situ oil shale retort contains a fragmented permeable mass of formation particles containing oil shale including a lower moiety and an upper moiety of said fragmented mass. The fragmented permeable mass of formation particles has top, bottom and side boundaries. A first portion of the formation is excavated from within the boundaries of the fragmented mass being formed to form a void. A second portion of the formation is excavated from within the boundaries of the fragmented mass being formed to form at least one additional void in communication with the first void and leaving a third portion to be expanded toward such an additional void. Fragmented particles from the excavation of such an additional void are deposited in the first void to provide a lower moiety of the fragmented permeable mass of formation particles. The third portion of the formation is explosively expanded toward such an additional void to provide an upper moiety of the fragmented permeable mass of formation particles. A retorting zone is passed through the upper and lower moieties of the fragmented mass for recovering liquid and gaseous products including shale oil.

18 Claims, 5 Drawing Figures

SITU RETORT WITH HIGH GRADE FRAGMENTED OIL SHALE ZONE ADJACENT THE LOWER BOUNDARY

BACKGROUND

This application relates to in situ recovery of liquid and gaseous products from an in situ oil shale retort.

The term "oil shale" as used in the industry is in fact a misnomer; it is neither shale, nor does it contain oil. It is a sedimentary formation comprising marlstone deposit with layers containing an organic polymer called "kerogen" which, upon heating, decomposes to produce hydrocarbon liquid and gaseous products. The formation containing kerogen is called "oil shale" herein and the hydrocarbon liquid product is called "shale oil."

One method for recovering shale oil is to form an in situ retort in a subterranean formation containing oil shale. Oil shale formation within an in situ retort site is fragmented to form a retort containing a fragmented permeable mass of formation particles containing oil shale. Formation particles at the top of the fragmented mass are ignited to establish a combustion zone, and an oxygen-supplying gas, such as air, is introduced to the top of the fragmented mass for sustaining the combustion zone and for advancing the combustion zone downwardly through the fragmented mass. As the combustion zone advances through the fragmented mass, hot processing gas from the combustion zone establishes a retorting zone on the advancing side of the combustion zone. In the retorting zone, kerogen in the formation particles is decomposed to produce shale oil and gaseous products. Thus, a retorting zone moves from top to bottom of the fragmented mass in advance of the combustion zone. The shale oil and gaseous products produced in the retorting zone pass to the bottom of the fragmented mass for collection.

U.S. Pat. Nos. 4,043,595 and 4,043,596 disclose methods for explosively expanding formation containing oil shale to form an in situ oil shale retort. Those patents are incorporated herein by this reference. According to a method disclosed in such patents, an in situ retort is formed by excavating formation to form a columnar void bounded by unfragmented formation having a vertically extending free face, drilling blasting holes adjacent the columnar void and parallel to the free face, loading explosive into the blasting holes, and detonating the explosive. This expands the formation adjacent the columnar void toward the free face so that fragmented formation particles occupy the columnar void and the space in the in situ retort site originally occupied by the expanded shale prior to such explosive expansion. The void fraction in the resulting fragmented mass is determined by the volume of formation removed from the retort site to form void space toward which unfragmented formation remaining in the retort site is explosively expanded, inasmuch as such unfragmented formation is fragmented and expanded to fill such a void space. The original void volume is essentially distributed between the fragmented formation particles in the retort being formed.

In the western United States oil shale deposits occur in generally horizontal beds, and within a given bed there are an extremely large number of generally horizontal deposition layers containing kerogen known as "varves." The kerogen content of the formation is often nonuniformly dispersed throughout a given bed.

The average kerogen content of formation containing oil shale can be determined by a standard "Fischer assay" in which a core sample customarily weighing 100 grams and representing one foot of core is subjected to controlled laboratory analysis. The sample is ground into small particles which are placed in a sealed vessel and subjected to heat at a known rate of temperature rise to measure the kerogen content of the core sample. Kerogen content is usually stated in units of "gallons per ton," referring to the number of gallons of shale oil recoverable from a ton of oil shale heated in the same manner as in the Fischer analysis.

The average kerogen content of formation containing oil shale varies over a broad range from essentially barren shale having no kerogen content up to a kerogen content to about 70 gallons per ton. Localized regions can have even higher kerogen contents, but these are not common. It is often considered uneconomical to retort formation containing oil shale having an average kerogen content of less than about 10 gallons per ton. If the average kerogen content is too low, it can be infeasible to retort in situ using a combustion zone in the fragmented mass since the energy available from burning carbonaceous material is not sufficient to heat the oil shale to retorting temperatures.

Formation containing oil shale that is suitable for in situ retorting can be hundreds of feet thick. Often there are strata of substantial thickness within such formation having significantly different kerogen contents than other strata in the same formation. Thus, for example, in one formation containing oil shale in Colorado that is a few hundred feet thick, the average kerogen content is in the order of about 17 gallons per ton. Within this formation there are strata 10 feet or so thick in which the kerogen content is in excess of 30 gallons per ton. In another portion of the same formation there is a stratum almost 30 feet thick having nearly zero kerogen content. Similar stratification of kerogen content occurs in many formations containing oil shale.

As described above, during at least some methods of forming an in situ oil shale retort a vertically extending columnar void is excavated within the formation. Such a vertical columnar void is necessarily located at elevations similar to the formation to be expanded by fragmenting, which also means that such a void be within a stratum of oil shale rich enough to be economically feasible to retort, i.e., having an average kerogen content of greater than about 20 gallons per ton. The fragmented particles formed during the excavation process forming such a void, therefore, contain relatively rich oil shale. Thus, there is a loss of potentially valuable products in the fragmented particles removed from the formation during the excavation of such a void. In the present processes, such fragmented material excavated during the formation of such a void is either discarded or removed to a separate retort to recover the products therein. It is desirable to have an in situ oil shale retorting process in which relatively rich formation excavated to form a void in the retort site is retained for retorting in situ.

SUMMARY OF THE INVENTION

There is, therefore, provided in the practice of this invention according to presently preferred embodiments, a technique of forming, in a subterranean formation containing oil shale, an in situ oil shale retort containing a fragmented permeable mass of formation particles containing oil shale including an upper moiety and a lower moiety of the fragmented mass. A portion of the formation is excavated from within the boundaries of the fragmented mass being formed to form a void therein. A second portion of the formation is excavated from within the boundaries of the fragmented mass being formed to form at least one additional void in communication with the first void, the surface of the formation defining such an additional void providing at least one free face extending through the formation within the boundaries of the fragmented mass being formed, and leaving a third portion of unfragmented formation within the boundaries of the fragmented mass being formed. Fragmented particles formed by the excavation of such an additional void are deposited in the first void thereby forming a lower moiety of the fragmented permeable mass of formation particles containing oil shale. The third portion of the formation is explosively expanded toward such an additional void to fragment said third portion and form an upper moiety of the fragmented permeable mass of formation particles within the boundaries of the retort.

The method of this invention is most beneficially practiced by excavating the first void within a stratum of formation having a relatively low kerogen content in comparison to the average kerogen content of the oil shale within the retort site. The fragmented mass when formed, however, contains an upper fragmented moiety and a lower fragmented moiety comprising formation particles from the strata adjacent the upper moiety of the fragmented mass.

A combustion zone is established in the upper portion of the upper moiety of the fragmented mass. An oxygen containing gas is introduced into the fragmented mass to maintain and advance the combustion zone through the upper and lower moieties of the fragmented mass. An off gas is withdrawn from the lower portion of the lower moiety of the fragmented mass whereby gas flow on the advancing side of the combustion zone establishes a retorting zone and advances the retorting zone through the upper and lower moieties of the fragmented mass, thereby producing liquid and gaseous products. The liquid products, including shale oil, are withdrawn from the lower portion of the lower moiety of the fragmented mass. The gaseous products are withdrawn with the off gas.

BRIEF DESCRIPTION OF THE DRAWINGS

These and other features and advantages of the present invention will be appreciated as the same becomes better understood by reference to the following detailed description of presently preferred embodiments when considered in connection with the accompanying drawings wherein.

DETAILED DESCRIPTION

Figure 1:
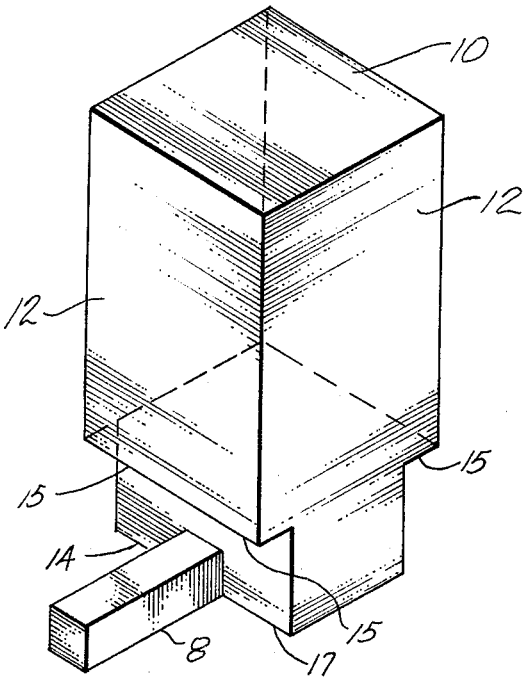
FIG. 1 illustrates schematically the general shape of one embodiment of in situ oil shale retort constructed in accordance with principles of this invention.

In one embodiment, this invention concerns techniques for forming and retorting an in situ oil shale retort which has a shape such as that illustrated schematically in FIG. 1. As illustrated in this drawing the in situ oil shale retort appears as a solid body, however, it will be recognized that this is a simplification for purposes of illustration. An in situ oil shale retort of this invention comprises a fragmented permeable mass of particles containing oil shale in a subterranean formation containing oil shale including an upper moiety and a lower moiety of the fragmented mass wherein the formation particles in the upper and lower moieties consist essentially of formation particles from elevations of the upper moiety of the fragmented mass. The average kerogen content of the lower moiety of the fragmented mass is substantially the same as the average kerogen content of the upper moiety of the fragmented mass. FIG. 1 illustrates the boundaries of such a fragmented permeable mass of particles to show one exemplary configuration.

As illustrated in FIG. 1 the fragmented permeable mass of particles has an upper boundary 10, four side boundaries 12 and a bilevel lower boundary 14 and 15. As illustrated in FIG. 1 the upper boundary 10 is substantially flat, however, it will be apparent that, if desired, it can have any desired shape, such as a somewhat domed configuration. Each level of the bottom boundary is also indicated to be substantially flat, however, it will be apparent that slopes can be included for ease in excavation of fragmented formation and/or for flow of liquid products from the retort. The side boundaries 12 of the in situ oil shale retort define a generally square or rectangular horizontal cross section.

A drift 8 at a production level provides a means for access to a lower boundary of the in situ oil shale retort. For purposes of this application the "production level" as used herein refers to the lower level of the in situ oil shale retort, i.e., the lower boundary thereof, at which level the liquid and gaseous products are removed from the retort. The production level generally refers to the lowest portion of the retort and the access drift to this lowest portion of the retort. The lower boundary in this embodiment is at two levels; an intermediate boundary 15, and a lower boundary 14. The locus of the intermediate boundary 15 defines the lower boundary of the upper moiety of the fragmented mass of permeable particles and the upper boundary of the lower moiety of the fragmented mass. The lower level, lower boundary 14, defines the bottom boundary of the lower moiety of the fragmented mass being formed. The volume defined by the upper boundary 10, lower boundary 14, intermediate boundary 15, and side boundaries 12 contains a fragmented permeable mass of particles containing oil shale including an upper and a lower moiety of the fragmented mass. The upper moiety of the fragmented mass is defined by the top boundary 10, side boundaries 12 and roughly by a horizontal plane at the elevation of the intermediate boundary 15. The lower moiety of the fragmented mass is defined by the lower boundary 14, side boundaries 17 and an upper boundary corresponding to the bottom boundary of the upper moiety of the fragmented mass. Some of the fragmented permeable mass can also be present in the end of the drift 8 near the bottom of the in situ oil shale retort.

During operation of the retort, an inlet gas used in processing for retorting of oil shale in the fragmented mass is introduced adjacent the top of the fragmented permeable mass. The drift 8 provides a means for collecting and recovering liquid products and withdrawing an off gas containing gaseous products from retorting oil shale in the in situ oil shale retort. A variety of retorting techniques can be employed, some of which are set forth in the prior art, and since this invention concerns forming the in situ oil shale retort, no further description of them is needed for one skilled in the art.

A method of forming an in situ oil shale retort involves excavating a first portion of the formation to form a first void 16 within the boundaries of the retort site. A second portion of the formation is excavated above and in communication with the first void to provide an additional void 18 within the boundaries of the retort site leaving a third portion of intact formation within the retort site. The fragmented material excavated from such an additional void is deposited in the first void to form a lower moiety of the fragmented permeable mass of formation particles. The third portion of the formation containing oil shale is then explosively expanded toward the additional void to form the upper moiety of the fragmented permeable mass of formation particles.

Figure 2:
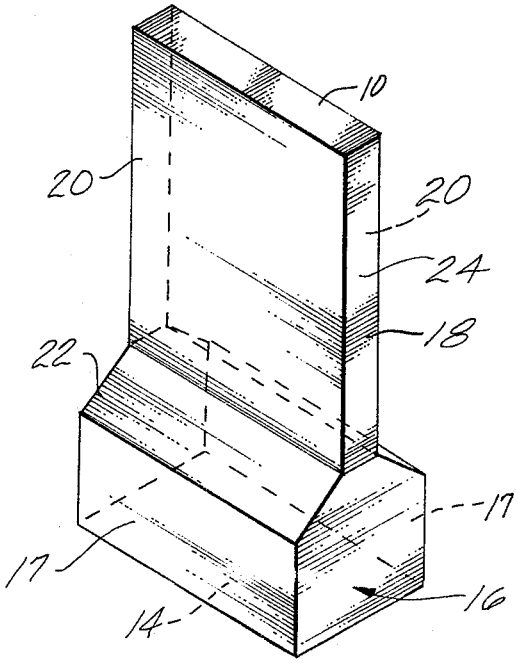
FIG. 2 is a schematic perspective illustration of the excavations for forming an in situ oil shale retort.
Figure 4:
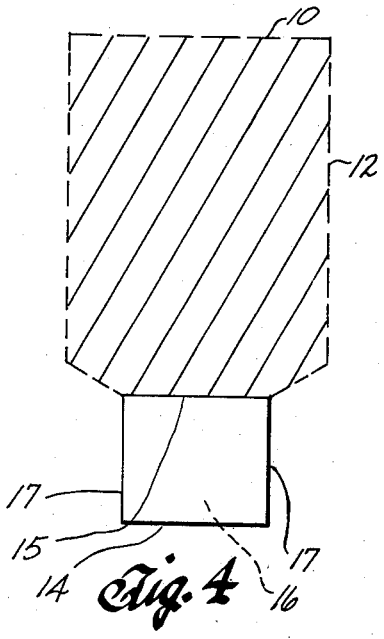
FIG. 4 is another vertical cross section through the middle of the in situ oil shale retort at an intermediate stage of construction.
Figure 3:
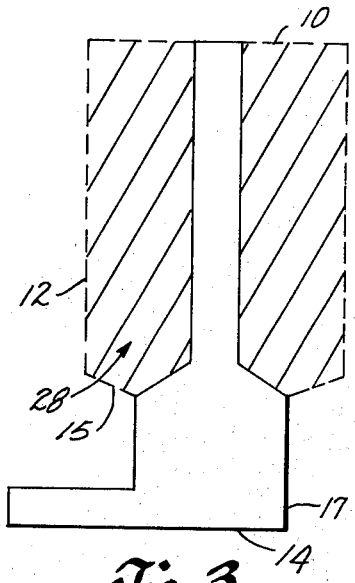
FIG. 3 is a vertical cross section through the middle of an in situ oil shale retort to depict the excavations illustrated in FIG. 2.
Figure 5:
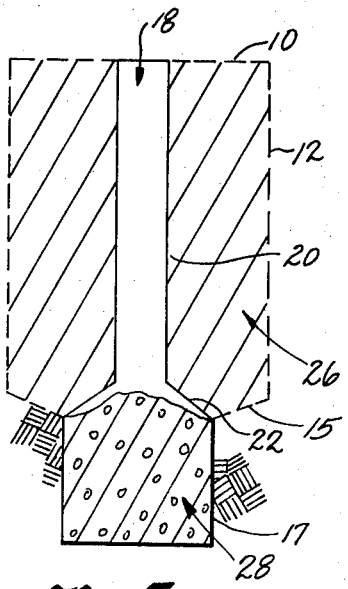
FIG. 5 is a vertical cross section through the middle of the in situ oil shale retort at an intermediate stage of forming the in situ oil shale retort later in time than the intermediate stage illustrated in FIG. 4.

FIGS. 2–5 illustrate an in situ oil shale retort being formed at intermediate stages in its preparation. FIG. 2 is a schematic perspective illustration of a group of undergound workings during an intermediate stage of development of the retort. It is drawn as if the solid rock were transparent and the excavations formed therein were solid objects. Thus, the near surfaces of the excavated spaces are shown solid and the far portions are shown as hidden lines. FIG. 3 is a vertical cross section illustrating the excavations depicted in FIG. 2. FIGS. 4 and 5 are vertical cross sections through the middle of the retort side during preparation and at two different periods of construction of the retort. In the drawings, the boundaries of the various excavations are indicated with straight lines. It will be recognized that some roughness of these surfaces will occur as is normal in blasting rock. The following description of an exemplary embodiment of this invention is made with reference to these figures.

In the illustrated embodiment the drift 8 on the production level provides a means for access to the lower portion of the excavation. It is advantageous to excavate the drift in such a location that the drift lies within a layer of relatively lean oil shale such as oil shale having a kerogen content of less than 10 gallons per ton, and below a layer of substantially richer oil shale. The particulate material formed during the excavation of the drift can be discarded as it would yield little shale oil.

From the access drift there is excavated a first portion of the formation within the boundaries of the in situ oil shale retort site within the layer of relatively lean oil shale and underlying a layer of relatively richer oil shale. The excavation of this first portion of the formation creates a first void 16 within the boundaries of the retort being formed. The particulate lean oil shale excavated to form such a first void can be removed through drift 8 for discarding. Such a first void 16, formed as shown in FIGS. 1, 3 and 4, has a lower boundary 14, side boundaries 17, and an upper boundary at about the elevation of the intermediate boundary 15. The void 16 can have any convenient shape such as the shape as illustrated by FIG. 2, having substantially a rectangular base and substantially perpendicular vertical sides. A sloping bottom can be provided for aiding flow of fragmented formation to a drift for excavation and flow of liquid products during retorting.

The excavation of the first portion of the formation can be conducted in any convenient manner such as the many techniques of drift mining or stoping known to those skilled in the mining art. The volume of this first void being excavated is from about 15 to about 20 percent of the total volume of the fragmented permeable mass of formation particles being formed. This assumes that the void is substantially filled with formation particles from a subsequently excavated additional void.

When the first void has been substantially excavated, a second portion of the formation is excavated from within the boundaries of the retort being formed to form an additional void 18 in communication with the first void. Such an additional void is excavated from within the retort site above the first void and into the layer of relatively richer oil shale. Excavation of such a void can be initiated by raise boring as disclosed in the above-mentioned U.S. Pat. Nos. 4,043,595 and 4,043,596. During raise boring, fragments of the formation fall into the first void 16.

For example, following completion of the excavation of the first void, a ten-inch diameter bore hole (not shown) is drilled downwardly through at least a portion of the overburden to the first void at about the center thereof. A conventional four foot diameter raise boring bit is then attached to the drill string extending through the bore hole down to the first void. A circular raise (not shown) is bored from the first void up to the top boundary 10 of the retort being formed.

Suitable raise boring bits from about four to about 12 feet in diameter are commercially available for forming such raises. Suitable apparatus and techniques for forming such a raise are provided in U.S. Pat. No. 4,095,656, entitled RAISE BORE DRILLING, by Gordon B. French.

In the illustrations of FIGS. 3 and 5, subsequent excavations have removed the walls of the initial bored raise over most of its length (or height) to form a slot 18. The initial raise is enlarged by a sequence of drilling operations and blasting. Drilling operations for enlarging the raise are conducted from above the retort being formed. Particles of formation of the relatively rich oil shale produced by the enlargement of the raise fall into lower void 16. FIG. 5 provides an illustration of the retort being formed and formation of the slot 18. The particulate matter 28 formed during the raise drilling and enlargement of the raise falls into the first void defined by lower boundary 14 and side boundaries 17 thereby forming the lower moiety of the fragmented permeable mass of formation particles, comprising substantially entirely formation particles from the relatively rich oil shale layer.

The slot 18 is formed by incrementally blasting the formation within the retort site around the initial bored raise in a substantially square configuration. Such a technique for incrementally enlarging the raise consists of drilling blasting holes downwardly through the formation within the retort site approximately parallel to the bored raise. In an exemplary embodiment $3\frac{5}{8}$ inches diameter drill holes are used for enlarging a raise from an initial four foot diameter bore hole to a square raise about 15 to 18 feet on a side. The outer blasting holes are about 13 feet apart in such an embodiment. Such blasting holes are drilled in a square pattern about the initial bored raise. Explosive is loaded into the blasting holes and shot in a single round with different time delays between detonations in each hole. A mixture of ammonium nitrate and fuel oil (ANFO) makes a suitable inexpensive explosive for the blasting described herein. A variety of explosive TNT slurries, dynamite compositions and the like are also available. The explosive can be loaded in such blasting holes to fragment the formation in increments from the intermediate boundary 15 of the retort site. In such a case the explosive is loaded into only the lower portion of the blasting holes. By using such an incremental method, the enlarged raise can be enlarged along its entire height to the top boundary of the retort site. As each increment is detonated, the resulting fragmented formation particles fall into the lower void. Following the explosive expansion of the initial raise, an enlarged raise of substantially square horizontal cross section is formed.

Subsequent blasting holes are drilled approximately parallel to the enlarged raise in a pattern to extend the raise in a horizontal manner parallel to one side of the retort being formed for forming a slot 18. Explosive is loaded into the blasting holes in groups and detonated for fragmenting the formation between these blasting holes and gradually enlarging the raise to form a slot. As the formation particles are formed they fall into the lower void 16.

The raise is continually enlarged in such a horizontal manner parallel to side boundaries 12 of the retort until a slot has been formed having side boundaries 20 and end boundaries 24 which end boundaries 24 coincide with opposite side boundaries 12 of the retort being formed. In an exemplary embodiment wherein an 18 to 20 foot wide slot is desired, the two outer blasting holes are about 15 feet apart and the burden to the square raise is about ten feet. The enlarged raise forming a slot defines a second vertically extending void through the formation within the retort site. Such a second void 18, as illustrated in FIGS. 2 and 5, has a somewhat sloping boundary 22 which defines a lower enlarged portion of the second void 18. The boundary 22 is sloped as a result of the explosive fragmentation which tends to break off the edges while forming the slot.

The longer side walls 20 of the slot provide vertically extending free faces within the side boundaries of the fragmented permeable mass of particles to be formed in the in situ oil shale retort site. In this embodiment the side boundaries of the fragmented permeable mass of particles formed by the expansion of formation towards the void formed by the vertical slot coincide with the side boundaries of the in situ oil shale retort site.

In other embodiments, a plurality of slots or other shapes of voids can be used and in such a case the boundaries of the fragmented permeable mass expanded toward one such void may not coincide with all of the side boundaries of the retort site. Thus, for example, in an embodiment disclosed in U.S. Pat. No. 4,043,596, a pair of slots are employed and separate parts of formation between the slots are expanded toward the respective slots.

The volume of the slot 18 or other such void or voids is less than the volume of the first void 16. The first void is excavated having a volume about 35 percent greater than the second void. Such a difference in volume is necessary to allow for the bulking factor of the fragmented particles being excavated during the formation of slot 18 and deposited in lower void 16. The bulking factor is the increase in the volume of particles removed from a formation and placed in a different location without any tamping or settling action exerted on the particles. The increase in volume is a result of the random size particles being placed in random fashion in the new location thereby having voids and air spaces between particles. For oil shale particles such a bulking factor has been found to be about 35 percent. The void fraction within the lower moiety of the fragmented permeable mass of formation particles is thereby from about 26 to about 30 percent of that lower moiety of the mass.

Further, it is preferred in each embodiment that the volume of such an additional void or voids excavated within the boundaries of the in situ oil shale retort be sufficiently small relative to the volume of the remaining portion of the formation which is to be expanded towards such an additional void that the resultant upper moiety of the fragmented permeable mass will have a void fraction of less than about 26 percent. Preferably, the volume of such an additional void is in the range from about 15 to about 26 percent of the volume of the upper moiety of the fragmented permeable mass to be formed. This results in a fragmented permeable mass having an average void fraction in the upper moiety in the range from about 15 to 26 percent. By having a higher void fraction in the lower moiety than in the upper moiety, the gas flow velocity through the smaller horizontal cross section of the lower moiety is not significantly increased above the gas flow velocity through the larger horizontal cross section of the upper moiety. This assures good gas flow through the upper and lower moieties of the fragmented mass of the in situ oil shale retort.

At this stage of formation of the in situ oil shale retort, as illustrated in FIG. 5, there is a group of interrelated excavations with a lower production level drift 8 providing means for access to the lower boundary of the in situ oil shale retort site. The lower void 16 is substantially filled with fragmented formation particles from the excavation of the upper void 18, forming a lower moiety of the fragmented permeable mass of formation particles containing oil shale. A slot-shaped void 18 extends upwardly from the lower moiety of the fragmented mass. The substantially planar faces 20 defining the sides of the slot provide free faces towards which the remaining portion of formation 26 within the retort site is later expanded.

After the slot or plurality of slots is excavated, the remaining third portion of the formation 26 within the retort site is explosively expanded toward such an additional void formed by the slot or plurality of slots. The formation can be expanded by drilling a plurality of blasting holes downwardly in the remaining formation within the retort site. In an exemplary embodiment, the blasting holes are each about ten inches in diameter and are in rows parallel to the faces 20 of the slot. The rows of blasting holes are drilled between faces 20 of the slot and side boundaries 12 of the formation being formed.

In an exemplary embodiment for forming a fragmented permeable mass about 118 feet square in horizontal cross section, a burden distance between the free face formed by the wall 20 of the slot and a first row of blasting holes is about 25 feet. A similar burden distance is used between adjacent rows of blasting holes. A somewhat larger spacing distance, almost 30 feet between adjacent blasting holes in each row, is used.

Explosive is loaded into each blasting hole and is detonated in all the blasting holes in a single round, i.e., in an uninterrupted series of explosions. Preferably, the explosive in the blasting holes is detonated such that a time delay occurs between each successive detonation, so that no two blasting holes are detonated simultaneously, thereby minimizing seismic effects from the explosive. Such a sequence of detonations continually creates new free faces for adjacent blasting holes for enhancing fragmentation of the formation. Such a sequence of expansion towards the slot or newly created free faces continues on both sides of the slot through the entire blasting pattern. It will be recognized that expansion of the formation is only one direction, i.e., generally toward the free face at the slot wall 20. It will also be apparent that many blasting sequences can be employed for assuring expansion of the formation to form an upper moiety of the fragmented permeable mass of particles in an in situ oil shale retort.

Although limited embodiments of technique for forming an in situ oil shale retort or retorts have been described and illustrated herein, many modifications and variations will be apparent to one skilled in the art. Thus, for example, the addition void or voids excavated for forming the upper moiety of the fragmented mass can extend horizontally across the retort site and the first void for forming the lower moiety can be excavated at a lower level with a raise or winze for passage of fragmented oil shale from the upper void to the lower void. In such an embodiment, explosive expansion is toward horizontal free faces rather than the vertical free faces hereinabove described. Such variations for expeditiously forming retorts should be considered to be within the scope of the appended claims.

What is claimed is:

1. A method of recovering liquid and gaseous products from an in situ oil shale retort in a subterranean formation containing oil shale, such an in situ oil shale retort containing a fragmented permeable mass of formation particles containing oil shale, said fragmented mass having top, bottom and side boundaries, comprising the steps of:

excavating a first portion of the formation from within the boundaries of the fragmented mass being formed within a layer of formation having an average kerogen content less than the average kerogen content of the oil shale within the boundaries of the fragmented mass being formed to form at least one first void;

excavating a second portion of the formation from within the boundaries of the fragmented mass being formed to form at least one additional void in communication with the first void, the surface of the formation defining such an additional void providing at least one free face extending through the formation within the boundaries of the fragmented mass being formed, and leaving a third portion of the formation, which is to be fragmented by expansion toward such an additional void, within the boundaries of the fragmented mass being formed and extending away from such a free face;

depositing the fragmented particles formed by the excavation of such an additional void in the first void for forming a lower moiety of the fragmented permeable mass of particles containing oil shale;

explosively expanding said third portion of formation toward such an additional void for fragmenting said third portion of formation, and forming an upper moiety of the fragmented permeable mass of particles within the boundaries of the retort;

establishing a combustion zone in the upper moiety of the fragmented mass;

introducing an oxygen containing gas to the fragmented mass for maintaining the combustion zone and advancing the combustion zone through the upper and lower moieties of the fragmented mass;

withdrawing an off gas from the lower moiety of the fragmented mass whereby gas flow on the advancing side of the combustion zone establishes a retorting zone in the fragmented mass and advances the retorting zone through the upper and lower moieties of the fragmented mass, thereby producing liquid and gaseous products, said gaseous products being withdrawn in the off gas; and withdrawing such liquid products from the lower moiety of the fragmented mass.

2. A method as recited in claim 1 wherein the second portion of the formation within the retort is excavated directly above the first void and the fragmented formation particles formed during the excavation fall into the first void.

3. A method as recited in claim 1 wherein such an additional void is excavated by forming a vertically extending slot between side boundaries of the fragmented mass being formed, the top of the slot being at the top boundary of the fragmented mass being formed and the bottom of the slot opening into the first void.

4. A method as recited in claim 3 wherein the first void is wider than such a slot.

5. A method as recited in claim 1 wherein the volume of the first void is sufficiently greater than the volume of such an additional void that the fragmented mass of formation particles removed from such an additional void substantially fills the first void.

6. A method as recited in claim 1 wherein the volume of the first void is about 35 percent greater than the volume of such an additional void.

7. A method as recited in claim 1 wherein the horizontal cross-sectional area of the first void is greater than the horizontal cross-sectional area of the second void.

8. A method as recited in claim 1 wherein such an additional void is excavated by the steps of:

forming a vertical raise from the first void to the top boundary of the fragmented mass being formed;

enlarging the raise in at least one horizontal direction to form a slot having a bottom portion in communication with the first void; and dropping the fragmented formation particles formed by the formation and enlargement of the raise in the first void to substantially fill the first void.

9. A method as recited in claim 1 wherein the void fraction of the upper moiety of the fragmented mass is less than about 26 percent and the void fraction of the lower moiety of the fragmented mass is greater than about 26 percent.

10. A method as recited in claim 1 wherein the average kerogen content of the lower moiety of the fragmented mass and the average kerogen content of the upper moiety of the fragmented mass are substantially equivalent.

11. A method of forming an in situ oil shale retort in a subterranean formation containing oil shale, such an in situ oil shale retort containing a fragmented permeable mass of formation particles containing oil shale, said fragmented mass having top, bottom and side boundaries, comprising the steps of:

excavating a first portion of formation from within such boundaries within a layer of formation having an average kerogen content less than the average kerogen content of the oil shale within such boundaries to form a lower void;

excavating a second portion of formation from within such boundaries to form an upper void vertically above the lower void;

dropping fragmented formation particles formed by excavation of the upper void from the upper void into the lower void for forming a lower moiety of a fragmented mass of formation particles in the in situ oil shale retort;

explosively expanding a third portion of formation within the boundaries of the retort toward such upper void for forming an upper moiety of the fragmented mass in the retort.

12. A method as recited in claim 11 wherein the upper void is excavated as a vertical slot extending between side boundaries of the retort and the bottom of the slot opens into the lower void.

13. A method as recited in claim 11 wherein the volume of the lower void is sufficiently greater than the volume of the upper void that the fragmented mass of formation particles removed from such upper void substantially fills the lower void.

14. An in situ oil shale retort in a subterranean formation containing oil shale, such an in situ oil shale retort containing a fragmented permeable mass of formation particles containing oil shale, comprising:

an upper moiety of the fragmented mass;

a lower moiety of the fragmented mass formed within strata of formation having an average kerogen content less than the average kerogen content of the oil shale within the retort site; and the fragmented permeable mass of formation particles in the upper and lower moieties consisting essentially of formation particles from strata adjacent the upper moiety of the fragmented mass.

15. An in situ oil shale retort as recited in claim 14 wherein the volume of the lower moiety of the fragmented mass is from about 15 to about 30 percent of the volume of the fragmented mass.

16. An in situ oil shale retort as recited in claim 14 wherein the lower moiety of the fragmented mass contains formation particles formed during the excavation of a void space within the retort site to which the upper moiety was explosively expanded.

17. An in situ oil shale retort as recited in claim 14 wherein the upper moiety of the fragmented mass is formed after the formation of the lower moiety of the fragmented mass.

18. An in situ oil shale retort as recited in claim 14 wherein the lower moiety of the fragmented mass has a void fraction of greater than about 26 percent and wherein the upper moiety of the fragmented mass has a void fraction of less than about 26 percent.

* * * * *

UNITED STATES PATENT AND TRADEMARK OFFICE

CERTIFICATE OF CORRECTION

PATENT NO. : 4,239,284

DATED : December 16, 1980

INVENTOR(S) : Richard D. Ridley and Robert J. Fernandes

It is certified that error appears in the above—identified patent and that said Letters Patent is hereby corrected as shown below:

IN THE TITLE:

Change "SITU RETORT WITH HIGH GRADE FRAGMENTED OIL SHALE ZONE ADJACENT THE LOWER BOUNDARY" to -- IN SITU RETORT WITH HIGH GRADE FRAGMENTED OIL SHALE ZONE ADJACENT THE LOWER BOUNDARY --.

IN THE SPECIFICATION:

Column 1, line 1, change "SITU RETORT WITH HIGH GRADE FRAGMENTED OIL SHALE ZONE ADJACENT THE LOWER BOUNDARY" to -- IN SITU RETORT WITH HIGH GRADE FRAGMENTED OIL SHALE ZONE ADJACENT THE LOWER BOUNDARY --.

Column 6, line 9, change "20" to -- 30 --.
Column 6, line 40, change "FIGS. 3 and 5" to -- FIGS. 2, 3 and 5 --.
Column 9, line 22, change "addition" to -- additional --.
Column 11, line 14, after the ";" insert -- and --.

Signed and Sealed this

*Fourteenth* Day of *April 1981*

[SEAL]

*Attest:*

RENE D. TEGTMEYER

*Attesting Officer* *Acting Commissioner of Patents and Trademarks*